United States Patent [19]

Schoenfelder

[11] Patent Number: 5,058,227

[45] Date of Patent: Oct. 22, 1991

[54] UNDER-BED HUMIDIFIER

[76] Inventor: George Schoenfelder, 2S965 Shagbark, Batavia, Ill. 60510

[21] Appl. No.: 625,433

[22] Filed: Dec. 11, 1990

[51] Int. Cl.[5] ..... A47C 21/04; B01D 47/02

[52] U.S. Cl. ..... 5/508; 5/284; 5/423; 261/119.1

[58] Field of Search ..... 5/284, 421, 423, 503, 5/508; 261/119.1

[56] References Cited

U.S. PATENT DOCUMENTS

| | | | |
|---|---|---|---|
| 1,936,960 | 11/1933 | Bowman | 5/423 X |
| 2,119,207 | 5/1938 | Gibbs | 261/119.1 X |
| 2,417,010 | 3/1947 | Mobley | 261/119.1 X |
| 2,967,051 | 1/1951 | Mobley | 261/119.1 X |
| 3,230,556 | 1/1966 | Shippel | 5/423 |
| 3,713,182 | 1/1973 | McNeal | 5/421 |
| 4,218,791 | 8/1980 | Itoku | 5/423 X |

*Primary Examiner*—Michael F. Trettel

*Attorney, Agent, or Firm*—Robert M. Wolters

[57] ABSTRACT

A humidifier is provided which lies beneath a bed or other article of furniture. The humidifier is of very shallow height, being much less in height than the length and width. The humidifier includes an open frame resting on the floor, and a sheet of plastic material lying over said frame and on said floor. A pool of water is supported by the plastic sheet material within the frame, and a fan is supported from said frame above said pool of water for moving air across the open surface of said pool of water and out from under said bed or the like.

13 Claims, 1 Drawing Sheet

UNDER-BED HUMIDIFIER

BACKGROUND OF THE INVENTION

In dry climates and in climates where only heating is required it is often necessary to add moisture to the air. Air that is too dry has an adverse effect on one's health through drying of membranes, etc. It also tends to break the joints on furniture and cause various aging effects on a home. Accordingly, it is well known that it is desireable to add moisture or to humidify the air. In hot air heating systems, it is common to humidify the air in the plenum of the furnace for circulation throughout the entire building.

With other types of heating systems, such as hot water, or with heating on a room-by-room basis it is not possible to humidify the air in a furnace plenum because there is none. Individual room humidifiers are known, but they are unsightly, and they take up space in the room which could be used for other purposes.

In very dry climates, humidification could have an additional advantage of cooling the air, since evaporating water in the air produces a temperature drop.

OBJECTS AND SUMMARY OF THE PRESENT INVENTION

In accordance with the principles of the present invention, it is an object thereof to provide a humidifier which is disposed in otherwise wasted space under a bed or other furniture.

A further object of the present invention is to provide a humidifier in the form of a kit made of simple and inexpensive materials and designed to be assembled by the homeowner and disposed beneath a bed or other article of furniture.

Still another object of the present invention is to provide a humidifier which has a very low vertical height, adapting it to be positioned beneath a bed or other article of furniture.

In attaining the foregoing and other objects, I provide a simple humidifier frame made up, for example, of 2 inch framing boards shaped in a rectangular pattern. Reasonably thin, flexible material, such as polyethylene is positioned over the frame and in close surface proximity thereto. The area within the frame thus forms a shallow, waterproof receptacle in which water is placed, the frame and plastic sheet material first being positioned beneath the bed or the like. A fan is supported above the pool of water and in the entrance of a duct that leads out from under the bed to cause air to move over the surface of the water, causing evaporation thereof, the evaporated water and air being forced out the duct into the room. In a further embodiment of the invention is possible to dispense with the duct, and simply have the fan blow the air from under the bed with the skirt or blankets lifted.

THE DRAWINGS

FIG. 1 is a perspective view of a bed with the humidifier of the present invention exposed beneath it;

FIG. 2 a vertical view looking down on the humidifier, a portion of the bed being broken away to permit viewing thereof;

DISCLOSURE OF THE ILLUSTRATED EMBODIMENTS

Figure 1:
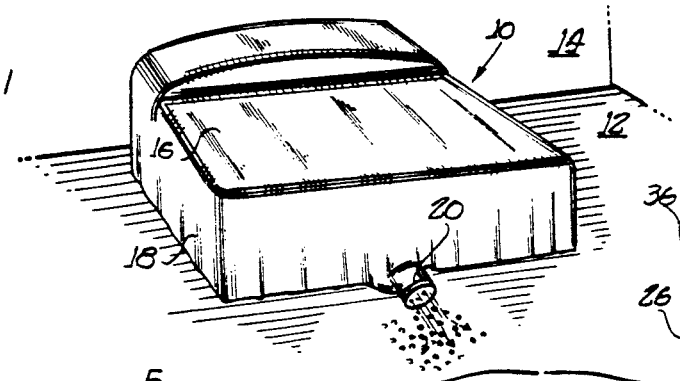

Referring first to FIG. 1, there will be seen a bed 10 resting on the floor 12 of a room 14. The bed is shown as made up and having a bedspread or the like 16 over it. The bed also is provided with a skirt 18, and this may be a separate skirt, or an integral part of the bedspread 16. A duct 20 extends out from under the skirt at a convenient location, preferably not directed against an article of furniture or the like that might be damaged by high humidity. It will be understood that some other article of furniture could be used rather than a bed, tut a bed is preferred, since it provides a much larger area, and since the bedspread and/or skirt provide for hiding the humidifier from view.

Figure 5:
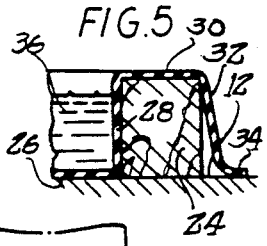
FIG. 5 is a detailed vertical sectional view taken substantially along the line 5—5 in FIG. 2, and on an enlarged scale.
Figure 2:
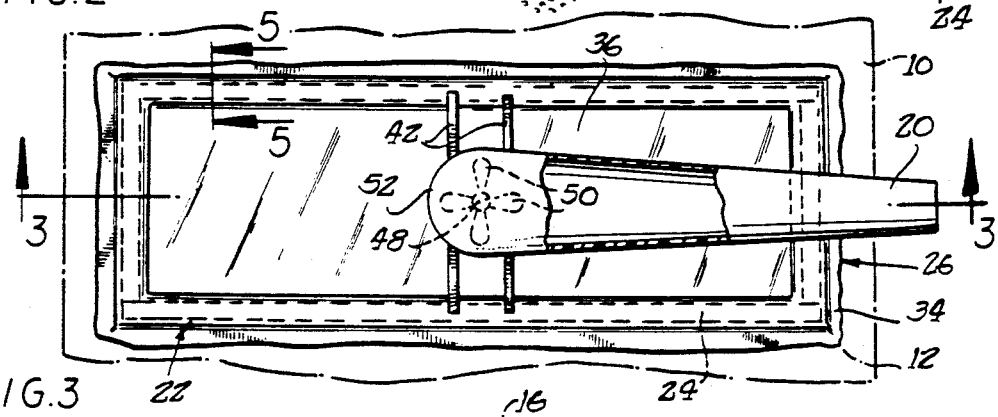
Figure 3:
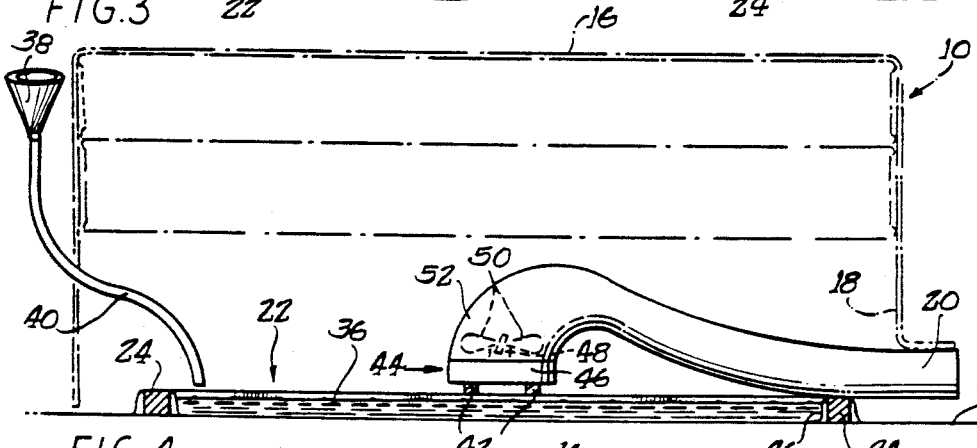
FIG. 3 is a vertical longitudinal sectional view through the humidifier, taken substantially along the line 3—3 in FIG. 2.

In FIGS. 2 and 3, the bed 10 and the bedspread 16 and skirt 18 are shown in phantom, since this simplifies illustration, and since the precise structure of the bed may vary from one installation to another, and is not particularly important. These two figures and also the detailed figure of FIG. 5, best show the structure of the humidifier which is designated generally 22. The humidifier includes a rectangular frame 24 which may be wood boards or framing members substantially of a nominal 2-inch square construction. Hollow cardboard tubes could be used instead, and various forms of metal or plastic structural members also could be used. The important thing is that may be something simple for a homeowner to handle and manipulate, and that are stable and do not take up too much space. The frame members 24 lie on the floor 12 of the room, and a water impervious sheet 26, preferably of a suitable plastic material such as pollyethylene, lies on the floor within the rectangular outline of the framing members 24. As best seen in FIG. 5, the plastic sheet 28 lies against the inner surface of each framing member 24 in close engagement therewith, and lies across the top of each framing member at 30. The edge portion of the sheet then drapes down somewhat loosely at 32 adjacent to the outer surface of each frame member, and somewhat irregularly engages the floor in a surrounding lip 34. Water 36 fills the area above the main central portion of the sheet 26 and against the upright or vertical portion 28 thereof, nearly to the top of the framing members 24. It will be appreciated that the framing members are secured together at the corners of the rectangular outline by nails or other conventional structure, whereby the frame is relatively rigid, thus rigidly defining the periphery of the pool of water 36. The waterproof sheet 26 need not be particularly strong since it is supported by the floor and by the framing members, and it is not intended to be moved.

For convenience of illustration, the outline of the framing members (24), and hence of the pool (36) is shown in FIG. 2 as being rather long and narrow. I have found that some what wider dimensions, such as 6 ft. by 3 ft. in a physical embodiment of the invention work very well beneath a conventional double bed.

Water is added to the pool 36 by means of a funnel 38 and tube 40, shown in FIG. 3. The funnel and the upper, end of the tube are disposed outwardly of the bed whereby water readily can be added to make up for water that has evaporated without any danger of getting water on the bed itself. The funnel and tube can be permanently left in place and hidden by the bed and adjacent draperies, or the funnel and tube may be stored at a remote location and disposed as shown in FIG. 3 only when needed for adding water.

A pair of elongated support members 42 spans the long sides of the frame 24 approximately midway from end to end, and spaced laterally of one another. These members 42 may be made of wood, metal, or plastic and are provided both for preventing deflection of the long frame members 24, and for supporting a fan structure 44. The fan structure includes a suitable frame 46 supporting a fan motor 48 having a shaft driving fan blades 50. Electrical power is supplied to the fan by a suitable flexible cable or dropcord, which is not shown since it is entirely conventional. The fan is housed within the inlet portion 52 of the duct 20. As illustrated, the duct is larger at its inlet end than it is at the outlet end, in order to use a fan of large enough diameter that it will not have to run too fast, and hence be noisy. The discharge end of the duct 20 preferably is of somewhat reduced diameter simply to prevent its being obtrusive in showing where it extends beneath the bed skirt 20.

The fan may operate continuously, or it may have a switch incorporated in the line cord for manually turning it on and off, or it may be controlled by a timer. In any event, it will mull air in from below the bed skirt completely around the periphery of the bed, thereby causing air to pass over the top of the water pool 36 substantially uniformly, and to be drawn by the fan blades 50 into the inlet portion 52 of the duct, or to disperse humidified air from the outlet end of the duct 20. This provides necessary humidity to the air, and in extremely dry areas it may also provide a certain amount of air conditioning through evaporation.

The duct 20 may be of any suitable construction, and the plastic and spiral wire type of construction commonly used for venting clothes dryers and the like is one satisfactory example.

Figure 4:
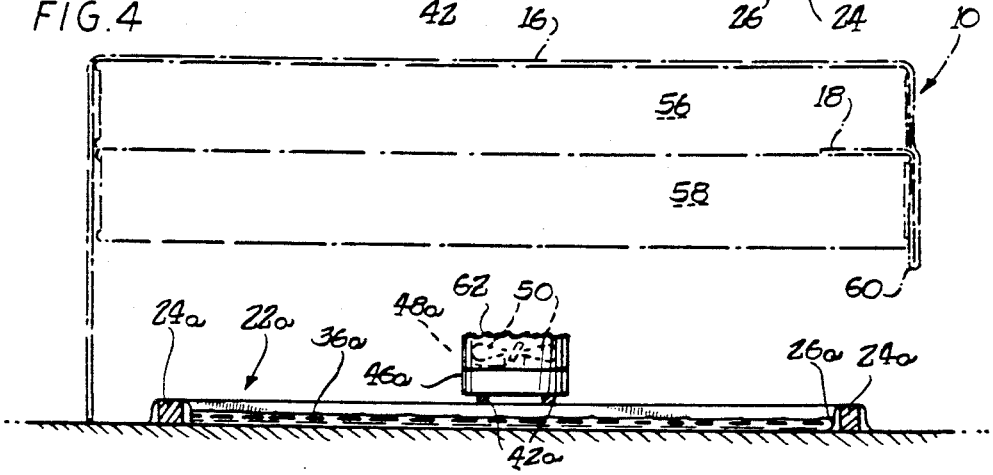
FIG. 4 is a view similar to FIG. 3 showing a modification of the invention.

A modification of the invention is shown in FIG. 4. The bed is totally unchanged, and the same numbers are used as heretofore insofar as the bed and its cover are concerned. There is a modification in the humidifier, and accordingly like numerals are used to identify similar parts, but with the addition of the suffix a.

The distinction in the embodiment of FIG. 4 is that the duct 20 is eliminated. A portion of the skirt 18 is lifted and tucked between the mattress 56 and underlying box spring 58, thereby leaving an opening along one portion of the bed as indicated at 60. With the duct eliminated a mesh 62 or other suitable fan guard is provided at the top of the housing **46*a* to prevent engagement of the fan blades with the fingers or other bodily parts if the fan should be run in a less restricted environment than under the bed. The fan will pull air along the surface of the water pool 36*a* from beneath the edges of the skirt 18, and will expel air through the opening 60 formed by the lifted portion of the skirt 18**.

The humidifier of the present invention can be made at very low cost, since the frame members 24 and supports 42 can be of readily obtained and relatively inexpensive materials, and the plastic sheeting 26, preferably used for the waterproof enclosure is quite inexpensive. It is apparent that the plastic sheet material can be of the clear variety, or of substantially any desired color, although in most cases this will not be terribly significant if the humidifier is disposed beneath a bed. However, it is contemplated that it right be disposed beneath other articles of furniture, and compatible coloration right then be desired. Additional features could readily be added, such as automatic fan shut-off when the desired humidity is reached within the room, a water level indicator, or automatic water fill. For simplicity the funnel 38 and tube 40 can be an integrated assembly or even a single piece, and can be hand held. The inner end of the tube can be permanently connected or secured to the humidifier in proper position with the upper end of the tube and the funnel simply tossed beneath the mad when not in use. Alternatively, it can be positioned entirely manually. The frame or support members 24 and the support members 42 may be of any suitable material including wood, metal, plastic, or wood products such as cardboard or fiberboard.

Reference has been made to placement of the humidifier under an article of furniture. This should be broadly construed. For example, in a factory the humidifier could be placed beneath a machine, which for purposes of the present application should be considered to be an article of furniture. The relatively shallow height of the present invention is important. In some instances it may be preferred to place the fan on the floor adjacent the body of the humidifier to blow air horizontally across the surface of the water. Although placement of the humidifier under an article of furniture or the like has been disclosed as a preferred example, the humidifier can be placed in other shallow spaces which would otherwise be simply waste space. For example, I have placed the humidifier above a bed. The humidifier could be hung from the ceiling as a tray.

The specific examples of the invention as herein shown and described are for illustrative purposes only. Various changes in structure will no doubt occur to those skilled in the art, and will be understood as forming a part of the present invention insofar as they fall within the spirit and scope of the appended claims.

The invention is claimed as follows:

1. The combination for humidifying air comprising an article of furniture such as a bed resting on a floor and having a bottom spaced above the floor with an open space beneath said bottom, and a humidifier disposed beneath said bed and having a body with a length, width, and depth, said depth being small relative to said length and said width, such humidifier being adapted to contain an open-topped pool of water therein, and a fan disposed above and supported from said body for moving air across said body to evaporate water from an open-topped shallow pool of water therein, said humidifier body comprising a peripheral frame with a flexible water-proof sheet laid over it.

2. The combination as set forth in claim 1 wherein said fan is an axial flow fan with a vertical axis.

3. The combination as set forth in claim 2 wherein said fan exhausts upwardly, thus drawing air across said pool.

4. The combination as set forth in claim 2 and further including a duct leading upwardly from said fan and curving from substantially vertical above said fan to substantially horizontal and extending out from beneath said article of furniture.

5. The combination as set forth in claim 4 wherein said duct has an inlet end adjacent said fan with a relatively large diameter, and an exit end at the opposite end thereof with a relatively small diameter.

6. The combination as set forth in claim 1 and further including a duct extending from said fan and leading out from beneath said article of furniture.

7. The combination as set forth in claim 1 wherein said frame comprises an open frame, and the center portion of said sheet within said frame is supported by said floor.

8. The combination as set forth in claim 7 wherein said frame is rectangular.

9. The combination as set forth in claim 7 wherein said waterproof sheet comprises a plastic film material.

10. A humidifier for adding moisture to air and comprising a body having a peripheral frame and means providing an underlying support surface and having length, width and depth, said depth being small relative to said length and width, a sheet of flexible waterproof material laid across said frame and supported by said support surface in conforming relation to said frame and to said support surface and adapted to contain an open-topped pool of water within said frame, and a fan supported from said body above said frame for moving air across the surface of a pool of water on said waterproof sheet within said frame to evaporate water from said open-topped pool.

11. A humidifier as set forth in claim 10 wherein said frame is an open frame and said support surface comprises a floor or the like on which said frame rests, and the waterproof sheet within said frame rests on the floor or the like on which the frame rests.

12. A humidifier as set forth in claim 11 wherein the frame is of rectangular outline.

13. A humidifier as set forth in claim 11 wherein the waterproof sheet material comprises a plastic film material.

* * * * *